United States Patent [19]

Fukuda

[11] Patent Number: 4,519,332

[45] Date of Patent: May 28, 1985

[54] METHOD FOR CONTROLLING A TUFTING MACHINE

[76] Inventor: Tsutomu Fukuda, Kakogawa-shi, Hyogo-ken, Japan

[21] Appl. No.: 560,393

[22] Filed: Dec. 12, 1983

[51] Int. Cl.[3] ..... D05C 15/20

[52] U.S. Cl. ..... 112/266.2; 112/272; 112/277; 73/160

[58] Field of Search ..... 112/266.2, 266.1, 262.1, 112/79 R, 272, 277, 278; 73/160

[56] References Cited

U.S. PATENT DOCUMENTS 4,084,434 4/1978 Goodrich et al. ..... 73/160

4,267,787 5/1981 Fukuda ..... 112/266.2

4,408,554 10/1983 Takiguchi et al. ..... 112/278 X

*Primary Examiner*—Peter Nerbun

*Attorney, Agent, or Firm*—Tak K. Sung

[57] ABSTRACT

A method for controlling a tufting machine in which a supply length of a ground fabric and a yarn feed length each for a unit stitch number are selected as control measures. Since the motion of a stitch shaft is steady and stable compared to that of a spiked roller, control in accordance with the present invention results in a stable operation of the tufted machine relative to the conventional method, in which the control measures are based on a unit supply length of the ground fabric. A yarn weight per square meter is also measured and indicated during the tufting operation.

2 Claims, 7 Drawing Figures

METHOD FOR CONTROLLING A TUFTING MACHINE

BACKGROUND OF THE INVENTION

1. Field of the Invention

This invention relates to a method for controlling a tufting machine used for manufacturing a tufted carpet by tufting pile yarns on a ground fabric.

2. Description of the Prior Art

Generally speaking, when controlling a conventional tufting machine, the number of stitches in a unit length of a tufted carpet is visually counted, a yarn length required for forming piles in a unit length of the carpet is calculated from the yarn weight to have been consumed, and the surface of the tufted carpet is inspected to ensure that it exhibits the desired color pattern. These factors are controlled, if necessary, by changing pulleys driving a spiked roller for the ground fabric and yarn feed rollers for the yarn to be tufted, respectively, or by manually adjusting speed changers of the same. However, such operations are very complicated and need higher skills and experience, and fine adjustment corresponding to the color pattern is very difficult.

To eliminate the above-mentioned drawbacks the present inventor has provided, in U.S. Pat. No. 4,267,787, a method for controlling a tufting machine in which the stitch number and the yarn feed length for a unit supply length of the ground fabric are measured continuously on the machine and, if the measured value or values exceeds an allowable range of the standard value, the supply rate of the ground fabric or the yarn are automatically controlled. In the method disclosed in the above U.S. patent, the revolution of the spiked roller is not reliable as a base for measuring a supply length of the ground fabric because the spikes are not always stuck into the ground fabric to a constant depth but to various depths according to the thickness of the fabric. Further, the spiked roller is disposed in a region remote from a driving source of the machine and connected thereto through various power transmitting mechanisms, therefore motion of the roller tends to be inaccurate. As a result, the method in which the standard values are determined for a unit supply length of the ground fabric lacks stability and is unsuitable for precise control.

In the market, a price of the tufted carpet largely depends on the weight of the pile yarn to be used. A trading price is agreed with both the carpet maker and the buyer referring to the designed weight of the yarn upon ordering. Thus, if the yarn weight exceeds the expected amount in the actual carpet, the carpet maker suffers an economical setback. Accordingly, it is important for the carpet maker to control a yarn weight for a unit area, usually for one square meter, of the resultant carpet (hereafter referred merely to as "yarn weight"). In addition, the yarn weight is the product of a yarn length to be used for tufting a ground fabric along a 1 m length thereof, the number of yarns required to cover a 1 m width of the ground fabric, and a yarn thickness. In the past, the measurement of the yarn weight is carried out by cutting out a 1 m square swatch from the tufted carpet, pulling out the pile yarns from the swatch and weighing them with a scale. To prepare the swatch, a 1.5 m length end portion has to be separated from the adjacent portion of the finished carpet. This causes a considerable pile yarn loss as well as an undue consumption of labour and operation time.

SUMMARY OF THE INVENTION

Accordingly, it is an object of the present invention to eliminate the above-mentioned drawbacks of the conventional control method and to provide a practical and convenient control method for controlling a tufting machine, characterized by measuring the supply lengths of a ground fabric and of a yarn to be tufted for a unit number of stitches, and automatically controlling the supply of the ground fabric and/or the yarn. This method results in a uniform and continuous manufacturing of the tufted carpet having a required colour pattern merely by setting standard values of the above two supply lengths depending on the designed colour pattern of the carpet, and allows accurate control without high skills.

It is another object of the present invention to provide a method for measuring the yarn weight upon tufting operation, by which the yarn weight of the carpet now on the machine can be displayed on a control panel, enabling the operator to maintain the machine in a suitable operative condition and produce a finished carpet of a desired yarn weight.

The first object of the present invention can be achieved by a method for controlling a tufting machine utilized for manufacturing a tufted carpet, by tufting yarns supplied by a yarn feed roller onto a ground fabric supplied by a spiked roller by means of needles, comprising presetting a standard supply length of a ground fabric and a standard yarn feed length, each for a predetermined unit number of stitches; determining an actual supply length of the ground fabric and an actual yarn feed length, each for a unit number of the stitches by means of measured values respectively obtained from a ground fabric supply detector, a yarn feed detector, and a stitch number detector; comparing the measured values with the standard values; and automatically controlling the rotational speeds of the spiked roller and/or the yarn feed roller, respectively, to correct the supply rate of the ground fabric and/or the yarn to the standard values when the measured values are above or below a predetermined allowable range for each of the standard values.

The second object of the present invention can be achieved by a method for indicating a yarn weight for a unit area of a tufted carpet while manufacturing the same by a tufting machine, by tufting yarns supplied by a yarn feed roller onto a ground fabric supplied by a spiked roller by means of needles, comprising pre-establishing a standard yarn feed length either for a unit stitch number or for a unit supply length of a ground fabric; determining an actual yarn feed length by means of measured values respectively obtained from a ground fabric supply detector, a yarn feed detector and a stitch number detector; inputting a signal for the determined yarn feed length to a calculating device together with signals for the number of yarns and a yarn thickness; multiplying the signal in the calculating device; and indicating the results on an indicator.

BRIEF DESCRIPTION OF THE DRAWINGS

The above and other objects and features of the invention will appear more fully hereinafter from a consideration of the following description taken in connection with the accompanying drawings illustrating embodiments according to the present invention.

Throughout the above drawings, the same reference numerals are utilized for designating identical or corresponding parts.

DETAILED DESCRIPTION OF THE PREFERRED EMBODIMENTS

[First Embodiment]

Figure 1:
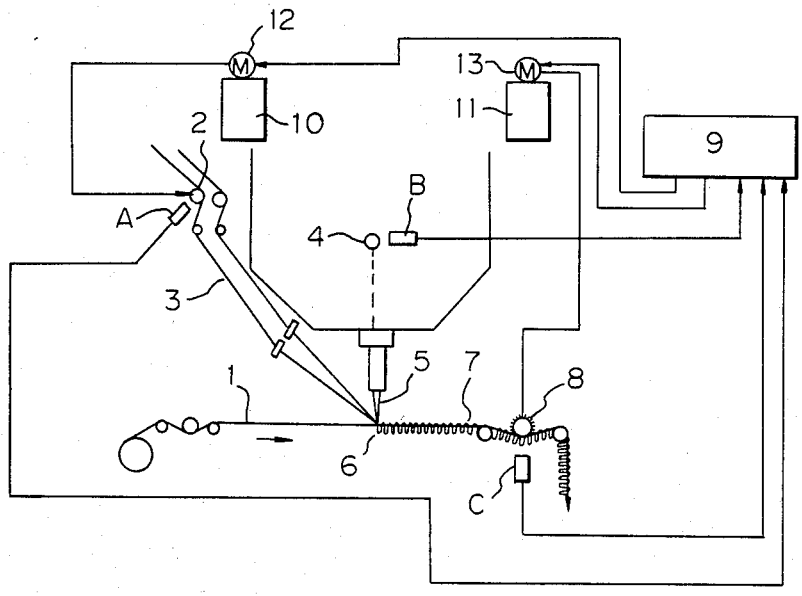
FIG. 1 is a diagramatical side view of a tufting machine to which the present invention is applied.

In FIG. 1, a yarn 3 supplied by a yarn feed roller 2 is stitched into a ground fabric 1 by means of a needle 5 driven by a stitch shaft 4 to form tufted piles 6. The tufted portion 7 of the fabric 1 is continuously taken out from the machine by means of a spiked roller 8.

During the tufting operation, a yarn feed detector A, which is devised to detect the supply speed of the yarn 2 by way of a photoelectric contactless switch, generates a definite number of pulses for a certain length of the fed yarn. A stitch number detector B, which is devised to detect a number of the strokes of the needle 5 corresponding to a stitch number by way of a magnetic contactless switch, generates a definite number of pulses for a rotation of a stitch shaft 4. Further, a ground fabric supply detector C, which is devised to detect the supply speed of the ground fabric 1 by way of a photoelectric contactless switch, generates a definite number of pulses for a certain length of the supplied ground fabric 1. The pulses issued from the detectors A, B and C are input to a control device 9 which determines the supply length of the ground fabric 1 and the feed length of the yarn corresponding to a unit number of stitches, compares these values with preset standard values, and generates an output signal when any of the values deviate from an allowable range of the corresponding standard value. This output signal causes pilot motors 12 and 13 to rotate so as to increase or decrease the output rotational speeds of the speed changers 10 and 11, such as PIV, which drive the yarn feed roller 2 and the spiked roller 8, respectively, whereby deviation of the process conditions of the tufted machine can be corrected.

Figure 2:
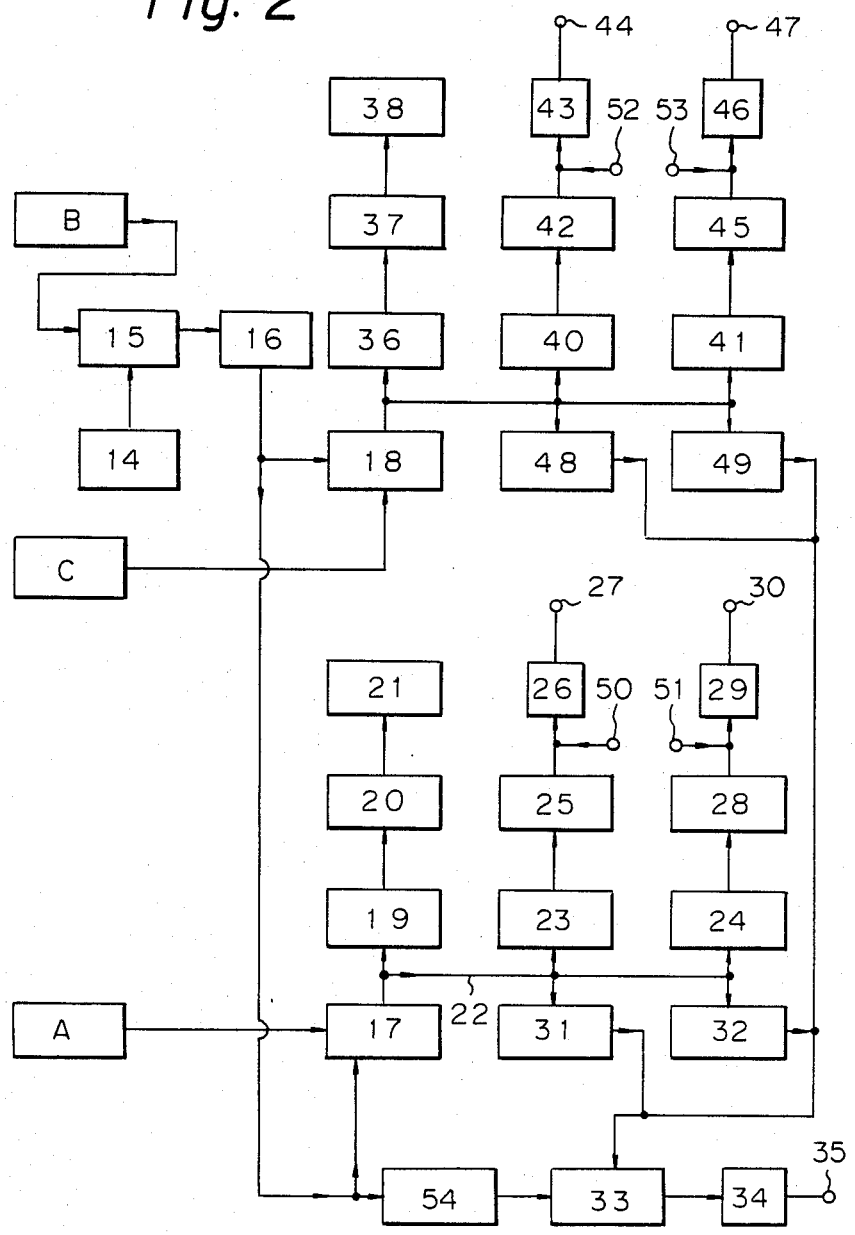
FIG. 2 is a block diagram illustrating a control circuit of a first embodiment according to the present invention.

FIG. 2 shows a block diagram indicating the control circuit of the above control device 9. A standard value setting device 14 is provided for setting the standard supply length of the ground fabric 1 and the standard yarn feed length for a unit stitch number corresponding to the color pattern of the desired carpet by way of a digital switch, and the set signals of the standard values are input to a synchronous counter 15. The synchronous counter 15 receives and counts the number of pulses issued from the stitch number detector B in synchronism with the rotation of the stitch shaft 4, which pulses correspond to the stroke number of the needle 5, and is devised to impart a standard set signal derived from the standard value setting device 14 to counters 17 or 18 through a gate 16, which opens when the synchronous counter 15 completely counts the number of pulses corresponding to the unit stitch number set in the standard value setting device 14.

The counter 17 counts the pulses issued from the yarn feed length detector A as well as the pulse number corresponding to the unit stitch number counted by the synchronous counter 15 during the time between successive gate pulses. The counted number of the former pulses represents the yarn feed length corresponding to the unit stitch number. The obtained pulse number is latched by a latch relay 19, and converted to a pile length or a ratio of the yarn length to the supply length of the ground fabric 1 by a decoder 20, which is displayed digitally on an indicator 21. The relationship between the ratio of the yarn feed length to the supply length of the ground fabric 1, and the pile length P, is expressed by the following equation:

$$P=(100\times R)/S,$$

where S is the stitch number.

The counter 17, further, is devised to compare the measured value of the yarn feed length for a unit stitch number with its standard value, and to evaluate the difference therebetween in the form of a plus or minus error percentage relative to the standard value. Thereupon, an error signal 22 is issued from the counter 17, corresponding to the error value.

The error signal 22 is input to upper and lower control limit setting devices 23 and 24 which are devised to be set to plus and minus allowable control limits, respectively, for the difference between the actual yarn feed length and the standard yarn feed length for a unit stitch number. When the error signal 22 exceeds the upper control limit, the upper control limit setting device 23 functions to initiate the issuance of a signal from a command signal generator 25 which, in turn, causes the issuance of a speed reducing command signal 27 through a relay 26. Conversely, when the error signal exceeds the lower control limit, the lower control limit setting device 24 operates to initiate the issuance of a corresponding signal from a command signal generator 28, which causes the issuance of a speed increasing command signal 30 through a relay 29. The above speed reducing command signal 27 or speed increasing command signal 30 is then communicated to the pilot motor 12. The pilot motor 12 is caused to rotate by the signal so as to change a reduction ratio of the speed changer 10 and, in turn, to decrease or increase the rotational speed of the yarn feed roller 2 until the error signal 22 is controlled within the allowable range between the upper and lower control limits.

Besides the control limit setting devices 23 and 24, an upper stop limit setting device 31 and a lower stop limit setting device 32 are provided, which are devised to register an upper stop limit higher than the upper control limit and a lower stop limit lower than the lower control limit and to issue a signal when the value of the error signal 22 exceeds the upper or lower stop limit. The signal from the device 31 or 32 actuates a stop signal generator 33, which causes the issuance of a stop signal 35 through a relay 34, to open a main switch of the tufting machine and to prevent the machine from damage.

Similar to the counter 17, the counter 18 counts the pulses issued from the detector C for the supply length of the ground fabric as well as the pulse number corresponding to the unit stitch number counted by the synchronous counter 15 during the time between successive gate pulses. Thus the counted number of the former pulses represents the supply length of the ground fabric for a unit stitch number. The obtained pulse number is latched by a latch relay 36, output of which is digitally displayed on an indicator 38, through a decoder 37, as a supply length of the ground fabric for a unit stitch number.

The counter 18 is further devised to compare the measured value of the supply length of the ground fabric for a unit stitch number with its standard value, and to evaluate the difference therebetween in the form of a plus or minus error percentage relative to the standard value. An error signal 39 is then issued from the counter 18 corresponding to the error value.

Numeral 40 designates an upper control limit setting device and numeral 41 designates a lower control limit setting device, both of which receive the error signal 39 and are devised to be set to plus and minus allowable control limits, respectively, for the difference between the actual supply length of the ground fabric for a unit stitch number. When the error signal 39 exceeds the upper control limit, the upper control limit setting device 40 operates to initiate the issuance of a signal from a command signal generator 42 which, in turn, causes the issuance of a speed reducing command signal 44 through a relay 43. Conversely, when the error signal 39 exceeds the lower control limit, the lower control limit setting device 41 operates to initiate the issuance of a signal from a command signal generator 45, which, in turn, initiates the generation of a speed increasing command signal 47 through a relay 46. The above command signal 44 or 47 is fed to the pilot motor 13.

The pilot motor 13 is caused to rotate by the signal so as to change a reduction ratio of the speed changer 10 and, in turn, to decrease or increase the rotational speed of the spiked roller 8, until the error signal 22 is controlled within the allowable range between the upper and lower control limits.

An upper stop limit setting device 48 and a lower stop limit setting device 49 have similar functions to the aforesaid stop limit setting devices 31 and 32, respectively, and issue a signal when the value of the error signal 39 exceeds the upper or lower stop limit. The signal from the device 48 or 49 causes a stoppage of the tufting machine through the stop signal generator 33 and the relay 34, as stated before.

Manual switches 50, 51, 52, and 53 are provided between each pair of command signal generators and relays such as 25 and 26, 28 and 29, 42 and 43, and 45 and 46 for enabling an increase or decrease of the rotational speed of the yarn feed roller 2 and the spiked roller 8, by generating a speed reducing command signal or a speed increasing command signal irrespective of the automatic control system stated above.

In a production output preset counter 54, a predetermined total stitch number required for producing a predetermined length of the carpet is memorized by means of a digital switch. The counter 54 counts pulses received from the gate 16 and issues a signal when the counted pulse number reaches the number corresponding to the preset total stitch number. Upon receiving the signal from the counter 54, the stop signal generator 33 issues the stop signal 35 through the relay 34. The counter 54 also displays the predetermined carpet length and the actual length thereof just being produced, by converting the stitch number to the supply length of the ground fabric 1.

Figure 3:
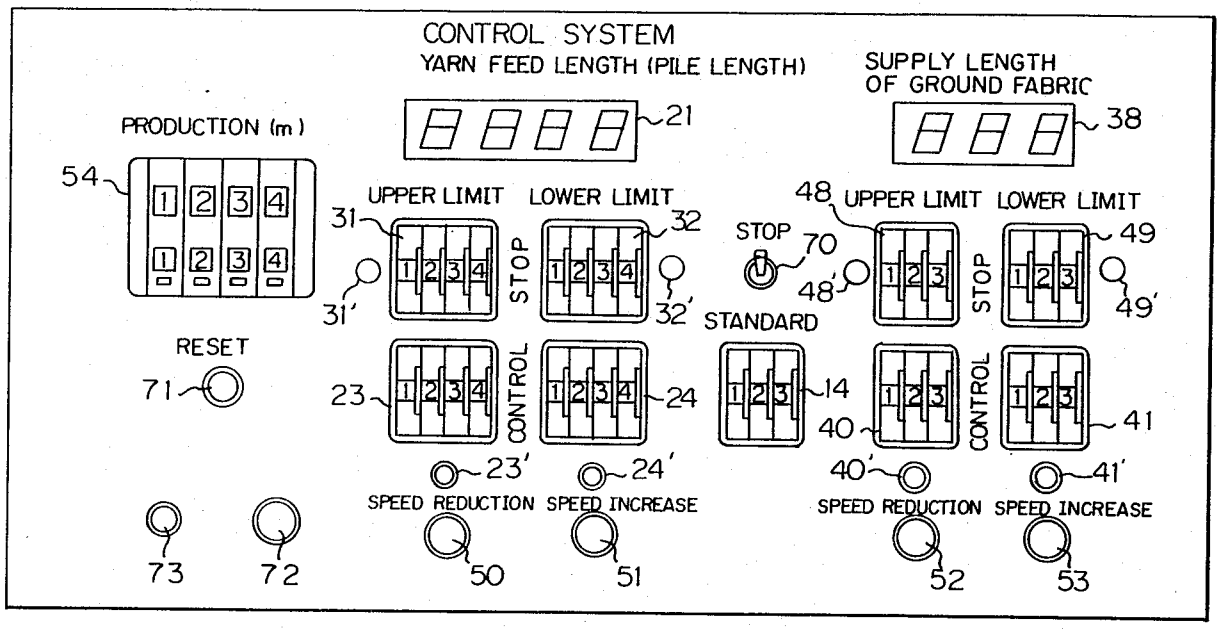
FIG. 3 is a front view of a control panel of the control circuit of the first embodiment.

In FIG. 3, numeral 70 designates a manual main switch of the tufting machine. A reset switch 71 is utilized for changing the standard value. Numerals 72 and 73 designate a starting button and a lamp for indicating that a power is "on", respectively.

Corresponding to the identical symbols in FIG. 2, numerals 38, 21, and 54 designate an indicator for the supply length of the ground fabric 1, a yarn feed length indicator, and a production output preset counter, respectively.

Numerals 23, 24, 31, and 32 designate an upper control limit setting device, a lower control limit setting device, an upper stop limit setting device, and a lower stop limit setting device, respectively.

Numerals 40, 41, 48 and 49 designate an upper control limit setting device, a lower control limit setting device, an upper stop limit setting device, and a lower stop limit setting device, respectively. Numeral 14 designates a standard value setting device. Values input in the above devices 38, 21, 54, 23, 24, 31, 32, 32, 40, 41, 48, 49, and 14 are all visually observed by digital indication on the control panel.

Numerals 23', 24', 31', 32', 40', 41', 48', and 49' designate alarm lamps attached to the limit setting devices 23, 24, 31, 32, 40, 41, 48, and 49, respectively. These lamps light corresponding to the correcting operation when the error value corresponding to the error signal 22 or 39 has exceeded the allowable limit, and inform the operator what error value has occurred and what kind of operation is being performed.

Numerals 50 and 51 designate manual switches for reducing and increasing the rotational speed of the yarn feed roller 2, respectively, and numerals 52 and 53 designate manual switches for reducing and increasing the rotational speed of the spiked roller 8, respectively.

The operation of the abovesaid control panel is described as follows;

First, the manual main switch 70 of the tufting machine is turned on and the standard supply length of the ground fabric and the standard yarn feed length for a unit stitch number determined from the color pattern of the carpet design are preset in the standard value setting device 14.

Next, the upper control limit setting devices 23 and 40, the lower control limit setting devices 24 and 41, the upper stop limit setting devices 31 and 48, and the lower stop limit setting devices 32 and 49 are set, respectively. Further, the predetermined carpet length is preset in the production output preset counter 54.

When the starting button is pushed "on", the tufting machine starts operations. As the operation progresses, the production output is successively indicated on the preset counter 54 and, when the output has reached the preset value, the tufting machine stops. During the production of the carpet, if the measured value of the supply length of the ground fabric 1 or the yarn feed length for a unit stitch number deviates from the standard value thereof, either of alarm lamps 23' and 40' or 24' and 41' corresponding to the upper control limit setting devices 23 and 40 or the lower control limit setting devices 24 and 41 light, to indicate that the correcting operation is being carried out automatically. If the above measured value largely deviates from the standard value, either of alarm lamps 31' and 48' or 32' and 49' corresponding to the upper stop limit setting device 31 and 48 or the lower stop limit setting apparatus 32 and 49 light, to indicate that an extraordinary state has occurred, and the tufting machine is stopped. After the cause of the machine failure has been removed, the machine can be started again by pushing the starting button 72. As stated before, the rotational speed of the yarn feed roller 2 or the spiked roller 8 can be changed by means of the manual switches 50, 51, 52, or 53, irrespective of the measured value.

Correction of the standard value is carried out by pushing the reset switch 56, thereby cancelling the original value, and resetting a new value.

The advantages of the present invention are as follows:

(1) As the stitch shaft is disposed closer to a driving source compared to the spiked roller, the motion of the stitch shaft is very steady compared to the spiked roller, because the path for power transmission is shorter for the former relative to the latter. Moreover, the rotation of the spiked roller is largely fluctuated by the thickness variance of the ground fabric. According to the present invention, since the stitch number which is synchronized with the motion of the stitch shaft is selected as a base of the standard value, the control of the tufting machine can be more stable and more precise compared to the prior art. Further, the causes of machine failure can be determined more easily and adjustment of the machine is simplified.

(2) Since the rotational speed of the spiked roller and the yarn feed roller are automatically corrected if the measured value deviates from the standard values, the machine can be controlled fully automatically.

(3) Constant watching of the tufting machine by the operator is unnecessary, unlike for the conventional machine.

Therefore, the number of personnel watching the operation can be reduced, human error can be avoided, and great labour saving can be made.

(4) Since the tufting machine can be controlled only by presetting the standard values of the supply length of the ground fabric and of the yarn, feed length in the control panel, the operation is very simple and requires no particular skill, i.e., even an unskilled operator can handle the machine, resulting in the completion of a uniform quality product.

(5) Since the rotational speeds of the spiked roller and the yarn feed roller are corrected either independently or in parallel, good control response can be obtained within a short period.

(6) Since the control can be performed without stopping the tufting machine, a great increase in the production output is expected.

(7) Since the correction accuracy can be set freely by adjusting the allowable limit range, fine control in accordance with the designed color pattern is possible.

The method according to the present invention is far more functional compared to the conventional method, and provides a practical and convenient control method for the tufting machine.

In the abovesaid embodiment, only one tufting machine is controlled, however, it is evident that the present invention can be embodied for the control of a plurality of tufting machines in parallel or separately, for example, through collective control by means of a minicomputer.

[Second Embodiment]

Figure 4:
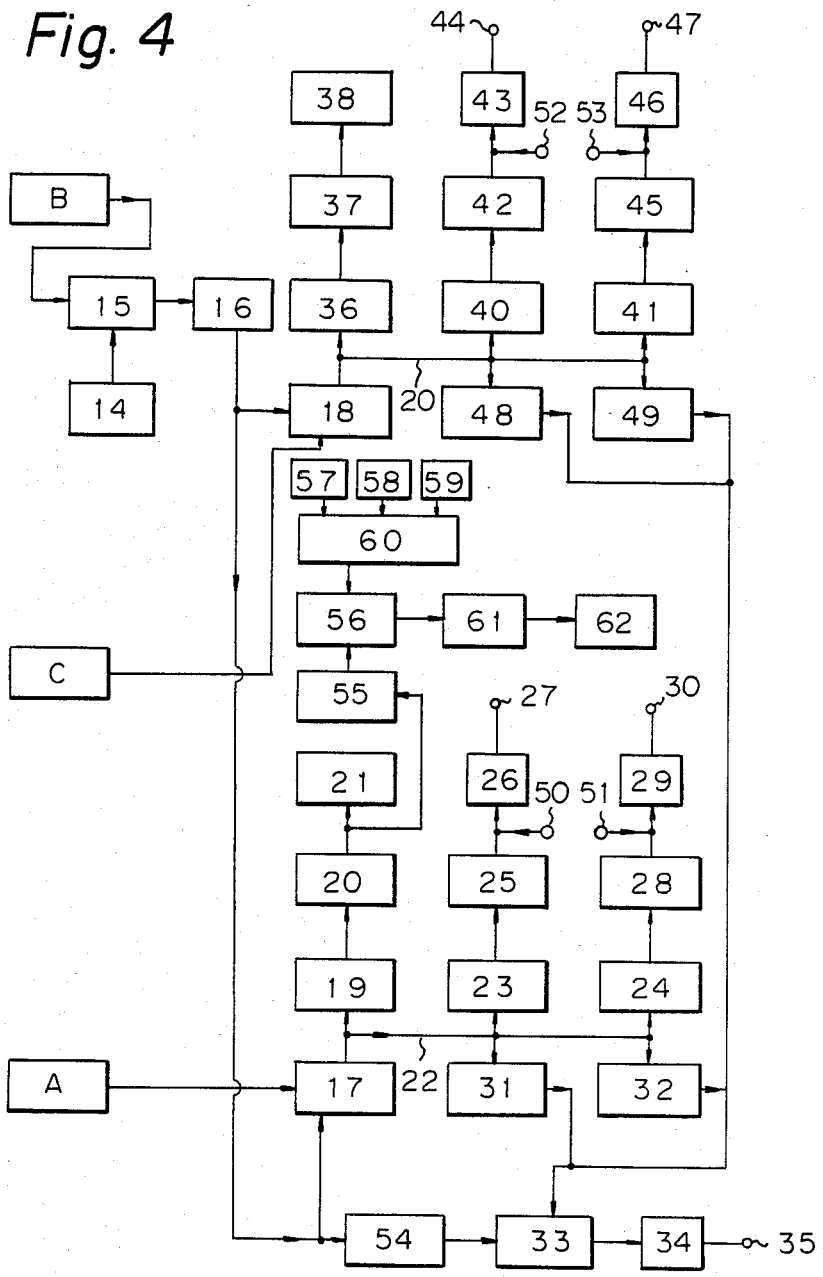
FIGS. 4 and 5 are views similar to FIGS. 2 and 3, respectively, in relation to a second embodiment according to the present invention.

A second embodiment according to the present invention is described below. This provides a method for successively measuring and displaying a yarn weight of the carpet on a machine during the tufting operation of the machine. A block diagram of the control circuit thereof is illustrated in FIG. 4.

The diagram is, in principle, similar to that shown in FIG. 2. The difference between the former and the latter is the provision of the subcircuit, in which the calculation of the yarn weight is carried out from the pulses generated from the detectors.

As explained in the first embodiment, a signal of a yarn feed length for a unit stitch number measured by means of a combination of a yarn feed length detector A and a stitch number detector B is issued from a decoder 20. The signal from the encoder 20 is communicated to a calculating device 56 through a encoder 55 by which the signal is multiplied by a fixed number n, where n is a number expressed by the equation $n=100/l$, and where l is a standard supply length in cm of a ground fabric for a unit stitch number. According to this multiplication, the signal from the encoder 55 to the calculating device 56 is converted to a value corresponding to a yarn length required for tufting a ground fabric 1 m in length. Signals from a yarn number setting device 57 in which the number of the yarns arranged for a 1 m width of the ground fabric is preset, a yarn thickness setting device 58, and a denier-count turnover switch 59, are input to the calculating device 56 through an encoder 60. From these input signals, a yarn weight required for tufting a ground fabric of 1 square meter, i.e., "a yarn weight" can be calculated by the operation of a yarn feed length X a yarn number X a yarn thickness. The results are indicated on a yarn weight indicator 62 through a decoder 61. As described above, either the denier or the count can be utilized for expressing the yarn thickness, and the switch 59 is set in suitable position corresponding to the selection thereof. The yarn thickness is preliminarily measured by a conventional yarn thickness tester and manually input in the digital form to the yarn thickness setting device 58.

Figure 5:
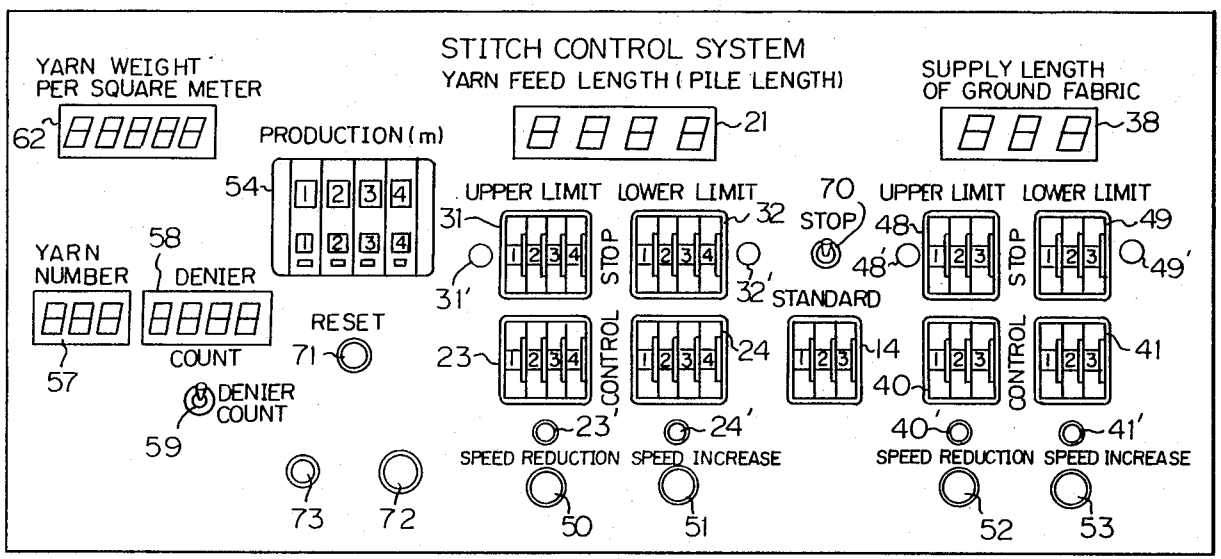

FIG. 5 illustrates a control panel for operating the circuit of the second embodiment. This panel is generally identical to that of the first embodiment shown in FIG. 3, except for a provision of the yarn number setting device 57, the yarn thickness setting device 58, the denier-count turnover switch 59, and the yarn weight indicator 62.

If the value on the yarn weight indicator deviates largely from a standard value, the correction is made for changing a supply length of the ground fabric and/or a yarn feed length. That is, the limit value of the standard supply length of the ground fabric preset in the control limit setting devices 49 and/or 50, or the limit value of the standard yarn feed length preset in the control limit setting devices 23 and/or 24, may be adjusted so as to result in the desired yarn weight.

According to the second embodiment, in addition to the automatic control of the tufting machine, the yarn weight can successively be displayed on the panel, thereby enabling the operator to handle the tufting machine more easily. Further, the loss of the carpet and the operation time accompanying the conventional yarn weight measurement can be avoided.

[Third Embodiment]

Figure 6:
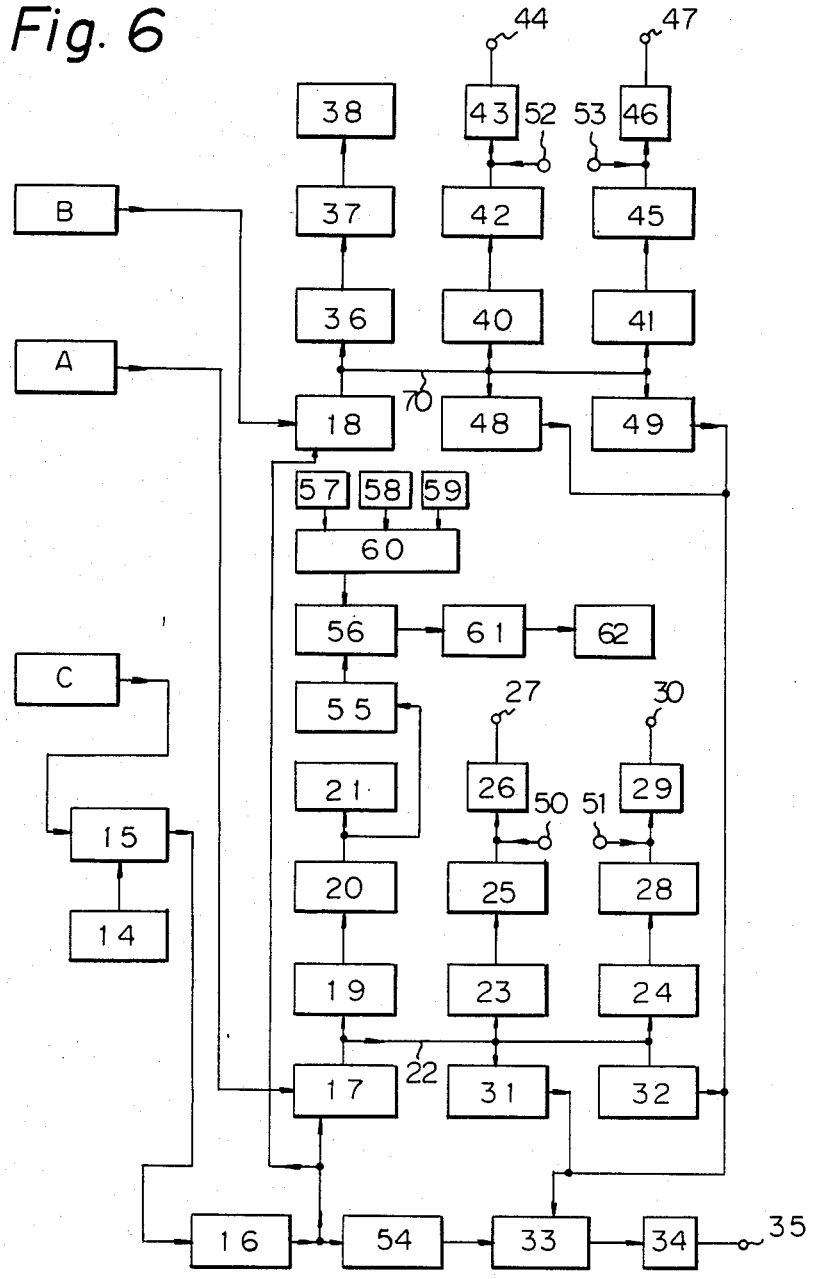
FIGS. 6 and 7 are views similar to FIGS. 2 and 3, respectively, in relation to a third embodiment according to the present invention.
Figure 7:
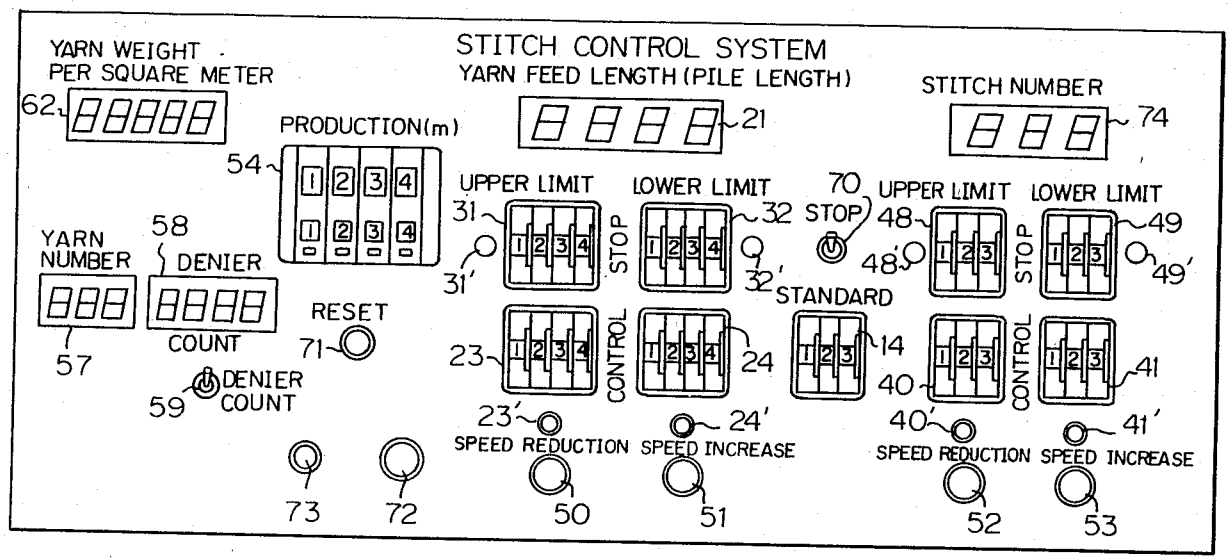

A third embodiment illustrated in FIGS. 6 and 7 is a modification of the second embodiment. In the second embodiment, the standard supply length of the ground fabric and the standard yarn feed length for a unit stitch number are determined, and the control operation is carried out to obtain the standard values. Contrary to this, in the third embodiment, the standard values are set for a stitch number and a yarn feed length for a unit supply length of the ground fabric.

In FIG. 6, a standard stitch number and a standard yarn feed length for a unit supply length of the ground fabric corresponding to the colour pattern of the aimed carpet are preset in the standard value setting device 14, by means of a digital switch, and the set signals of the standard values are input to the synchronous counter 15. The synchronous counter 15 receives and counts the number of pulses issued from the ground fabric supply detector C in synchronism with the rotation of the spiked roller 8 and is devised to give a standard set signal derived from the standard value setting device 14 to the counters 17 and 18 through the gate 16 which opens when the synchronous counter 15 completely counts the number of pulses corresponding to the unit ground fabric supply length preset by the standard value setting device 14.

The counter 17 counts the pulse number corresponding to the unit supply length of the ground fabric counted by the synchronous counter 15 and the pulses issued from the yarn feed detector A during the time between successive gate pulses, and thereby measures the yarn feed length corresponding to the unit supply length of the ground fabric. The obtained pulse number is latched by the latch relay 19, and converted to a pile length or a ratio of the yarn feed length to the supply length of the ground fabric by the decoder 20, which is expressed digitally on the indicator 21. The counter 17 is devised to compare the measured value of the yarn supply length for a unit supply length of the ground fabric with its standard value, and to evaluate the difference therebetween in the form of a plus or minus error percentage relative to the standard value. Thereupon, an error signal 22 is issued from the counter 17 corresponding to the error value.

The signal of the yarn feed length issued from the decoder 20 is input to the calculating device 56 through the encoder 55, by which the value of the yarn feed length is multiplied m times. The reason for the multification of the value is to convert a unit supply length L of the ground fabric for which the yarn feed length is measured to 1 m. Therefore, the multiplier m is the quotient of 100 divided by the length L in cm.

The yarn weight is calculated in the calculating device 56 by referring to the data input from the yarn number setting device 57, the yarn thickness setting device 58, and the denier-count turnover switch, and is indicated on the indicator 62 through the decoder 61.

The control operation of the tufting machine is carried out in the similar way as that for the second embodiment.

I claim:

1. A method for controlling a tufting machine utilized for manufacturing a tufted carpet by stitching yarns supplied by a yarn feed roller onto a ground fabric supplied by a spiked roller by means of needles; comprising:

pre-establishing a standard supply length of a ground fabric and a standard yarn feed length, each for a predetermined unit stitch number;

determining an actual supply length of the ground fabric and an actual yarn feed length, each for a unit stitch number by means of measured values respectively obtained from a ground fabric supply detector, a yarn feed detector, and a stitch number detector;

comparing the measured values with the standard values; and automatically controlling the rotational speeds of the spiked roller and/or the yarn feed roller, respectively, to correct the supply rate of the ground fabric and/or the yarn to the standard values when the measured values exceed upper or lower limit of a predetermined allowable range for each of the standard values.

2. A method for measuring a yarn weight of a tufted carpet while manufacturing the same by a tufting machine by tufting yarns supplied by a yarn feed roller onto a ground fabric supplied by a spiked roller by means of needles; comprising:

pre-establishing a standard yarn feed length either for a unit stitch number or for a unit supply length of a ground fabric;

determining an actual yarn feed length by means of measured values respectively obtained from a ground fabric supply detector, a yarn feed detector, and a stitch number detector;

inputtting a signal for the determined yarn feed length to a calculating device together with signals for the number of yarns and a yarn thickness;

multiplying the signals in the calculating device; and indicating the results on an indicator.

* * * * *